US005944901A

United States Patent [19]

Landes et al.

[11] Patent Number: 5,944,901

[45] Date of Patent: Aug. 31, 1999

[54] INDIRECT PLASMATRON

[75] Inventors: Klaus Landes, München; Jochen Zierhut, Ottobrunn; Ralf Hartmann, Baldham, all of Germany

[73] Assignee: Sulzer Metco AG, Wohlen, Switzerland

[21] Appl. No.: 08/994,091

[22] Filed: Dec. 19, 1997

[30] Foreign Application Priority Data

Dec. 23, 1996 [CH] Switzerland ..... 3171/96

[51] Int. Cl.[6] ..... H05H 1/00

[52] U.S. Cl. ..... 118/723 ER; 156/345; 219/121.47; 219/121.48; 219/121.5; 219/121.52

[58] Field of Search ..... 118/723 E, 723 ER; 156/345; 219/121.48, 121.5, 121.47, 121.52

[56] References Cited

U.S. PATENT DOCUMENTS 4,948,485 8/1990 Wallsten et al. ..... 219/121.5

5,239,161 8/1993 Lang ..... 219/121.47

*Primary Examiner*—Thi Dang

*Attorney, Agent, or Firm*—Tarolli, Sundheim, Covell, Tummino & Szabo

[57] ABSTRACT

The indirect plasmatron comprises a neutrode assembly comprising a plurality of plate-shaped electrode members which are electrically insulated from each other. In its interior, the neutrode assembly defines an elongated plasma channel. The outlet aperture for the plasma torch is in the shape of an elongate slot and extends parallel to the central longitudinal axis of the plasma channel. Each of the two electrodes of the plasmatron is surrounded by a cavity through which an inert gas can be fed into the plasma channel. For the purpose of stabilizing the electric arc, at least one pair of permanent magnet members is provided. Their magnetic field exerts a force onto the electric arc which is directed opposite to the force exerted onto the electric arc by the flow of the plasma gas. Particular neutrodes are provided with a channel for feeding a further gas into the plasma channel.

12 Claims, 2 Drawing Sheets

INDIRECT PLASMATRON

FIELD OF THE INVENTION

The present invention refers to an indirect plasmatron for treating surfaces, particularly to an apparatus for creating an electrically non conducting plasma jet escaping from a nozzle device in which the electric arc is not transferred to the work piece to be treated. In contrary thereto, in so-called direct plasmatrons, the electric arc is transferred to the work piece.

Such plasmatrons are adapted to create a plasma having a very high temperature, particularly in the region of up to several 10'000 Kelvin.

Indirect plasmatrons known in the art usually comprise a nozzle member from which an essentially cone-shaped plasma jet escapes. Thus, the surface portion of a substrate to be treated by such a plasmatron which is hit by the plasma jet has a circular shape. In many cases, however, this is disadvantageous, particularly in the case if a big rectangular surface of a work piece has to be heated or coated by means of an indirect plasmatron.

A further disadvantage to be observed in connection with such known indirect plasmatrons may be seen in the fact that the surface portion hit by the plasma jet is comparatively small because the aperture of the outlet nozzle has a limited diameter and because a predetermined maximal distance between outlet nozzle and surface of the work piece has to be maintained.

PRIOR ART

U.S. Pat. No. 5,239,161 discloses a method and an apparatus for treating the surface of a substrate, e.g. by depositing a coating thereon by plasma flux spraying by means of which it appears possible to avoid the afore mentioned disadvantages. An electric arc is established inside a chamber between a cathode and an anode and an inert gas is injected into the chamber so that it is ionized on passing through the electric arc, thereby forming a high temperature plasma. The plasma is ejected from the chamber through an ejection nozzle whose outlet orifice is in the shape of a slot. The electric arc established inside the chamber between the cathode and the anode runs along an axis substantially parallel to the extension of the outlet slot of the ejection nozzle. By such a design, it should be achieved that the plasma jet escaping from the outlet nozzle has an essentially rectangular cross section and is relatively wide.

Even if the basic idea behind such an apparatus, per se, is very interesting, practice has shown that such a plasmatron cannot ensure a reliable operation; particularly, severe problems have been observed with respect to the stability of the electric arc and the useful service life of the plasmatron.

OBJECTS OF THE INVENTION

In order to avoid the above mentioned drawbacks of the methods and apparatuses known in the prior art, it is an object of the invention to provide an improved indirect plasmatron in which a very stable electric discharge can be maintained, and in which the useful service life particularly of the electrodes, and even more particularly of the anode, is considerably increased.

SUMMARY OF THE INVENTION

In order to meet these and other objects, the present invention provides an indirect plasmatron for treating surfaces, comprising a neutrode assembly having two opposite end faces and defining an elongated plasma channel, a first electrode body member provided with a first electrode, and a second electrode body member provided with a second electrode. The first and second electrode body members are connected with the neutrode assembly each at one of its opposite end faces. The first and second electrodes are located in coaxial relationship with the central longitudinal axis of the plasma channel. Each of the electrodes is surrounded by a cavity through which an inert gas from an inert gas source is supplied to the plasma channel.

The neutrode assembly comprises a plurality of plate-like neutrode members which are electrically insulated from each other, and the neutrode assembly is provided with a slot-shaped outlet aperture for the plasma torch which runs parallel to the central longitudinal axis of the plasma chamber. Moreover, the neutrode assembly includes a permanent magnet assembly creating a magnetic field which exercises a force in a direction opposite to the direction of flow of the plasma gas.

Due to the cascaded design of the neutrode assembly, comprising a plurality of plate-like neutrode members which are electrically insulated from each other, it is ensured that the electric arc will take its way through the plasma channel and does not jump successively from one neutrode member to the subsequent one. Moreover, such a cascaded design allows for adjusting the width of the neutrode assembly and, thereby, the width of the outlet orifice according to the particular requirements.

The characteristic, that each of the electrodes is surrounded by a cavity through which an inert gas from an inert gas source is supplied to the plasma channel, the thermal stress on the electrodes is substantially reduced because an inert gas, e.g. argon, continuously flows around the electrodes. This enables not only an improved cooling of the electrodes, but allows also for a control of the area in which the electric arc starts and ends, respectively. Particularly, by appropriately selecting the inert gas, the size of the area in which the electric arc starts and ends, respectively, can be increased or decreased. In order to obtain a foot or base point as diffuse as possible, preferably argon is selected as the inert gas.

Moreover, by providing one or several pairs of permanent magnet members located in the neutrode assembly, the shape and the position of the electric arc can be controlled. In a plasmatron in which the outlet orifice of the plasma jet runs parallel to the longitudinal axis of the plasma channel, this point is quite important because the electric arc is forced into a curved shape under the influence of the plasma gas flowing in a direction cross-wise to the longitudinal axis of the plasma channel. Without the provision of such permanent magnet member pairs, the electric arc could be deviated and curved, respectively, to such an extent that it is subjected to heavy fluctuations and, in the worst case, even is interrupted. By the provision of the permanent magnet members, this can be avoided inasmuch as the permanent magnet pairs create a magnetic field which exercises a force in a direction opposite to the direction of flow of the plasma gas. By appropriately selecting the number, placement and strength of the permanent magnet members, the operational parameters of the plasmatron, e.g. amount of plasma gas and flow velocity thereof, can be taken into account to maintain the electric arc in a desired position.

According to a preferred embodiment, in which channels provided in particular neutrode members are connected to a first source of gas and the cavities around the electrodes are connected to a second, different source of gas, it is possible to individually select the kind of the inert gas and the kind of the plasma gas. One advantage of this design is that a reactive gas can be supplied through the channels provided in particular neutrode members, without the danger that such reactive gas decreases the useful service life of the electrodes, because the electrodes always are surrounded by a shield of inert gas.

BRIEF DESCRIPTION OF THE DRAWINGS

In the following, an embodiment of the invention will be further described, with reference to the accompanying drawings, in which.

DETAILED DESCRIPTION OF THE PREFERRED EMBODIMENT

Figure 1:
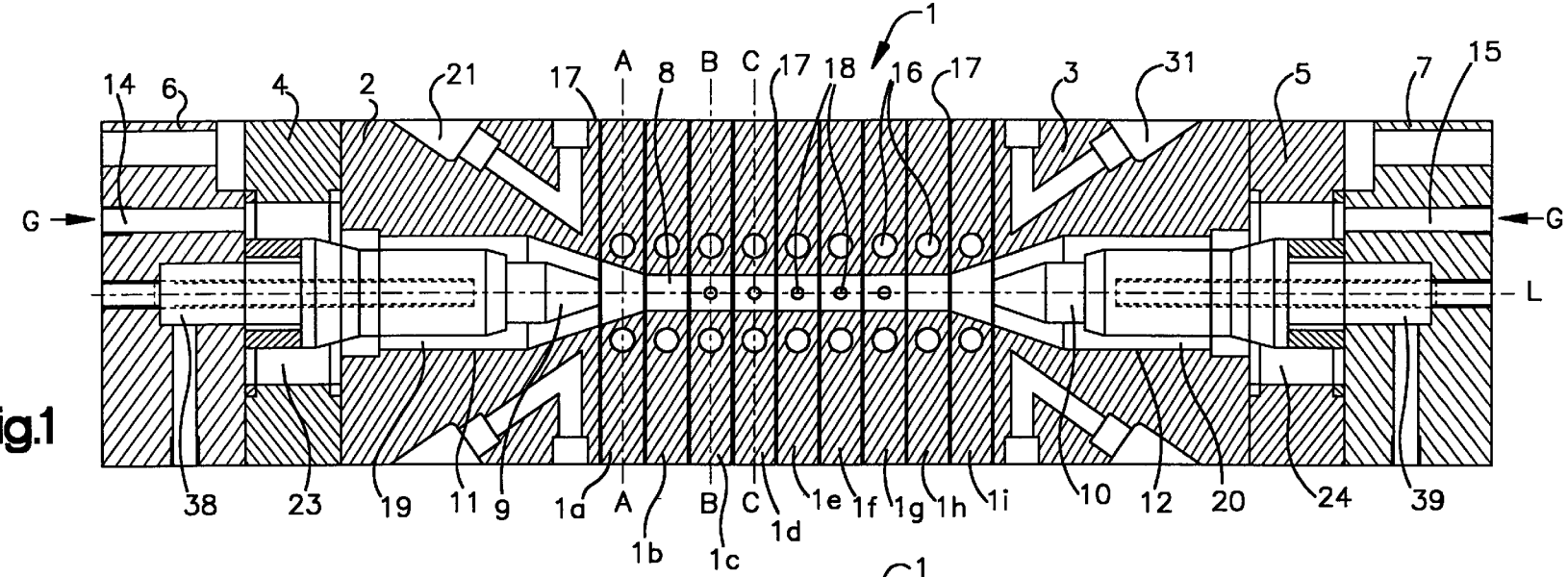
FIG. 1 shows a schematic longitudinal sectional view of an indirect plasmatron.

FIG. 1 shows a longitudinal sectional view of an embodiment of an indirect plasmatron; it should be noted that only the characteristics essential for the present invention shall be further described in the following with reference to this drawing figure.

The indirect plasmatron essentially comprises a central neutrode assembly 1. At the left side, next to the neutrode assembly 1, there is provided an electrode body member 2, next to the electrode body member 2, there is provided an insulating body member 4, and next to the insulating body member 4, there is provided a connector body member 6. Correspondingly, at the right side, next to the neutrode assembly 1, there is provided an electrode body member 3, and next to the electrode body member 3, there is provided an insulating body member 5, and next to the insulating body member 5, there is provided a connector body member 7. The connector body members 6 and 7, respectively, are adapted to receive an electrode member 9 and 10, respectively; in the present example, the left side electrode member 9 is the cathode and the right side electrode member 10 is the anode.

The neutrode assembly 1 comprises a plurality of neutrode members 1*a* . . . 1*i* which are of a plate-like design and which, together, delimit or define a plasma channel 8. The two electrode members 9 and 10 are in coaxial relationship with respect to the longitudinal central axis L of the plasma channel 8. In order to increase the value of the electrical resistance of the neutrode assembly 1, as seen along the extension of the plasma channel 8, the individual neutrodes 1*a* . . . 1*i* are electrically insulated from each other. As an insulation, insulating washers 17 can be provided which are inserted between the neutrodes 1*a* . . . 1*i*.

The neutrode assembly 1 is delimited on both sides thereof by the afore mentioned electrode body members 2 and 3, respectively. The electrode body members 2 and 3 are made of an electrically insulating material. Mounted to the free end faces of the electrode body members 2 and 3, respectively, are the afore mentioned insulating body members 4 and 5, respectively, and mounted to the free end faces of the insulating body members 4 and 5, respectively, are the afore mentioned connector body members 6 and 7, respectively. For the sake of simplicity, the mounting means required for fixing the afore mentioned elements to each other are not shown in the drawings.

In order to provide for a cooling of the plasmatron, the neutrode members 1*a* . . . 1*i* are provided with cooling water channels 16. Moreover, both electrode body members 2 and 3 are provided with cooling water channels 21 and 31, respectively. Also the electrodes 9 and 10 comprise internal cooling water channels 38 and 39, respectively, whereby all these cooling water channels 16, 21, 31, 38 and 39 are connected to an external cooling water circuit (not shown in the drawings).

Some of the nine neutrode members 1*a* . . . 1*i*, i.e. the five centrally located neutrode members 1*c*, 1*d*, 1*e*, 1*f* and 1*g*, are provided each with a plasma gas channel 18 centrally opening into the plasma channel 8 and extending perpendicularly thereto. Moreover, those five central neutrode members 1*c* . . . 1*g* are provided with a slot-shaped aperture 33 (FIGS. 3 and 4) together defining a plasma jet outlet opening 40 (FIG. 1*a*).

The electrode body member 2 comprises a centrally located bore 11 which tapers towards the plasma channel 8 and into which the electrode 9 extends in such a way that a cavity in the shape of an annular chamber 19 is created, delimited by the outer surface of the electrode 9 and the wall of the bore 11. The annular chamber 19 communicates, via a bore 23 provided in the insulating body member 4, with an inlet channel 14 provided in the connector body member 6. Accordingly, the electrode body member 3 comprises a centrally located bore 12 which tapers towards the plasma channel 8 and into which the electrode 10 extends in such a way that a cavity in the shape of an annular chamber 20 is created, delimited by the outer surface of the electrode 10 and the wall of the bore 12. The annular chamber 20 communicates, via a bore 24 provided in the insulating body member 5, with an inlet channel 15 provided in the connector body member 7. Both inlet channels 14 and 15 are fed with a plasma gas, as symbolized by the arrows G in FIG. 1, by means of a (not shown) plasma gas supply means.

Figure 1A:
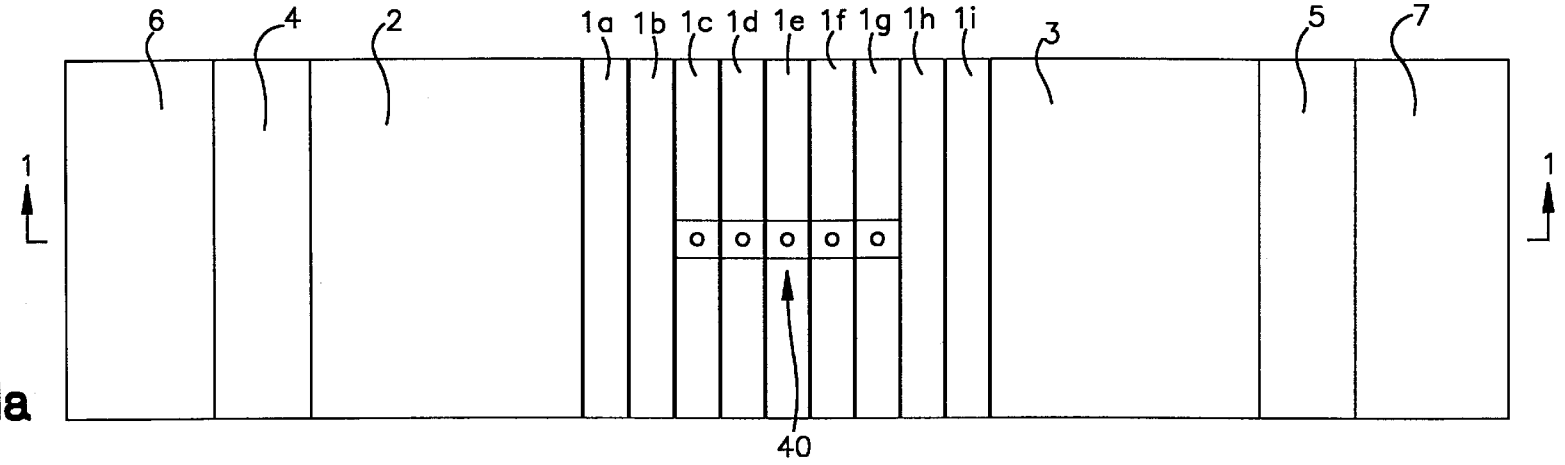
FIG. 1*a* shows a front view of the indirect plasmatron of FIG. 1.

FIG. 1*a* shows a front view of the indirect plasmatron of FIG. 1. In this figure, the above mentioned plasma jet outlet opening 40, extending over the width of the five central neutrode members 1*c* . . . 1*g*, can be clearly seen.

Figure 2:
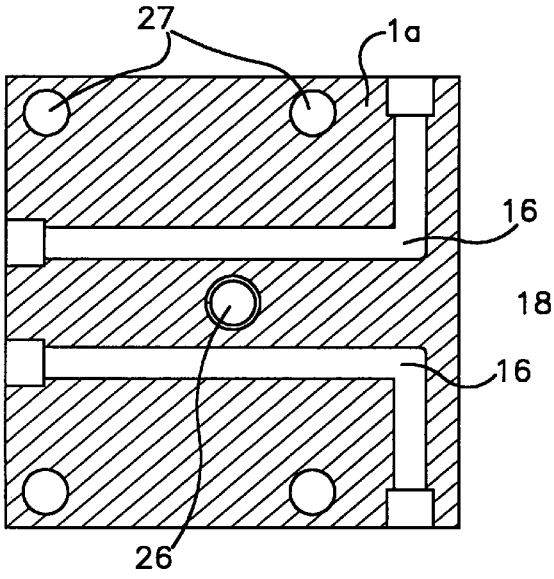
FIG. 2 shows a first cross sectional view of the indirect plasmatron, taken along the lines A—A in FIG. 1.

FIG. 2 shows a cross sectional view of the plasmatron according to FIG. 1, taken along the line A—A, particularly a cross sectional view of the neutrode member 1*a*. In this figure, it can be seen that the neutrode member 1*a* is provided with a centrally located bore 26 which is part of the plasma channel 8 and which serves for guiding the electric arc created between the electrodes 9 and 10. It is understood that also the neutrode members 1*b*, 1*h* and 1*i* (FIG. 1) of the neutrode stack are provided with a corresponding central bore, constituting each a portion of the plasma channel 8 as well and, together, serving for stabilizing the electric arc created between the two electrodes 9 and 10.

All neutrode members 1*a* . . . 1*i* are provided with cooling channels 16 to be connected to an external cooling water circuit (not shown) for efficiently cooling the neutrode stack. By means of bores 27 (FIG. 2), provided in all neutrodes 1*a* . . . 1*i*, the individual neutrodes as well as the insulating washers 17 can be fixed to each other to form a neutrode stack. The required fixing and, if required, sealing means are omitted in the drawings for reasons of simplicity.

Figure 3:
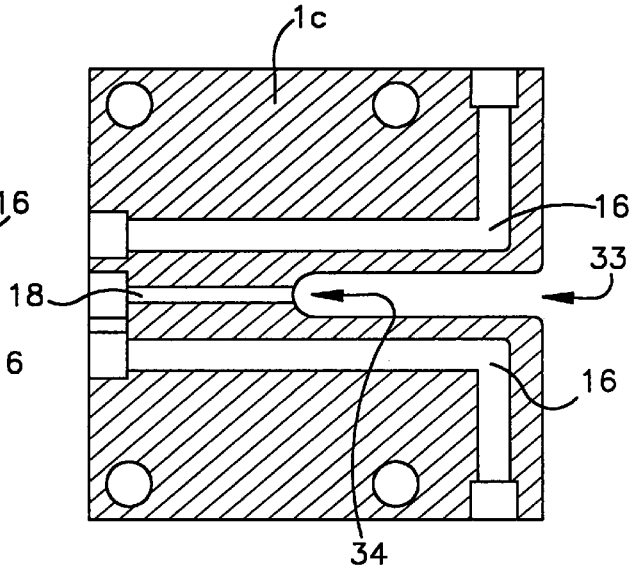
FIG. 3 shows a second cross sectional view of the indirect plasmatron, taken along the lines B—B in FIG. 1.

The neutrode member 1*c* shown in a cross sectional view in FIG. 3 does not comprise a central aperture 26 like the neutrode member 1*a* shown in a cross sectional view in FIG. 2, but is provided with a slot-shaped aperture 33 in place of that aperture. The aperture 33 again forms a portion of the plasma channel 8 (FIG. 1). Simultaneously, the slot-shaped aperture 33 opening to the outside of the indirect plasmatron forms a portion of the plasma jet outlet aperture 40 (FIG. 1*a*). It is understood, that the neutrode members 1*c*, 1*d*, 1*e*, 1*f* and 1*g* are also provided each with an identical slot-shaped aperture 33 with the result that the plasma jet outlet aperture 40 (FIG. 1*a*) extends over the width of five neutrode members 1*c* . . . 1*g*.

The inner end of the slot-shaped aperture 33 is constituted by a wall portion 34 having a semi-cylindrical or, as seen in the sectional view of FIG. 3, a semi-circular shape. Thereby, the plasma gas channel 18 opens into the slot-shaped aperture 33 in the center of the semi-cylindrical wall portion 34.

Figure 3A:
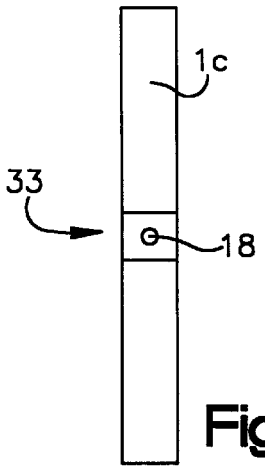
FIG. 3*a* shows a front view of a single neutrode.

FIG. 3*a* shows a front view of the neutrode member 1*c* shown in a sectional view in FIG. 3. Again, in this view, the slot-shaped aperture 33 as well as the mouth or orifice of the plasma gas channel 18 can be recognized.

Figure 4:
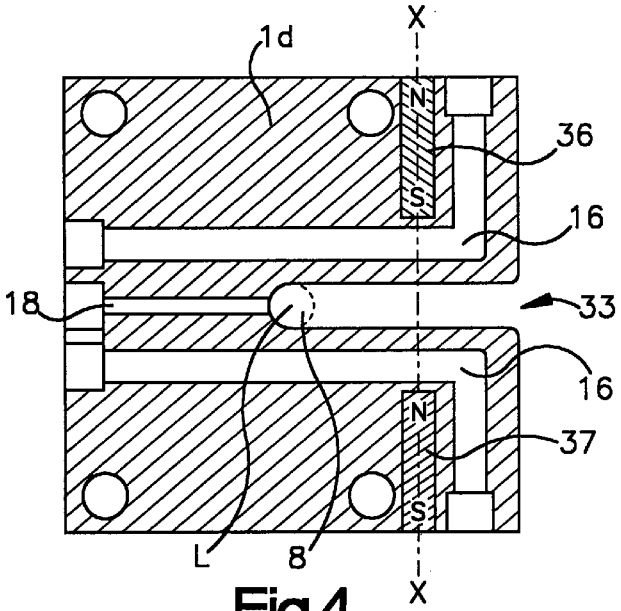
FIG. 4 shows a third cross sectional view of the indirect plasmatron, taken along the lines C—C in FIG. 1.

The shape and design of the neutrode member 1*d* shown in a sectional view in FIG. 4 essentially corresponds to the ones of the neutrode member 1*c* shown in FIG. 3; however, the neutrode member 1*d* of FIG. 4 is additionally provided with permanent magnet members 36 and 47, respectively. The permanent magnet member 36 is located above the slot-shaped aperture 33, and the permanent magnet member 37 is located below the slot-shaped aperture 33. Each of the permanent magnet members 36, 37 has a north-south axis X, and the two magnet members 36, 37 are arranged such that the north-south axis coincide. That common axis X—X runs essentially perpendicularly to the longitudinal axis L of the plasma channel 8, whereby the magnet members 36, 37 are located between the longitudinal axis L of the plasma channel 8 and the outlet of the slot-shaped aperture 33 or, as seen in the direction of flow of the plasma jet, downstream of the longitudinal axis L of the plasma channel 8. By such a placement, it can be achieved that the magnetic fields produced by the two magnet members 36, 37 exercise a force onto the electric arc which is directed opposite to the direction of flow of the plasma gas, with the result that the electric arc is stabilized in a desired position. It is understood that in each case opposite poles of the magnet members 36, 37 are opposite to each other, i.e. the south pole of magnet member 36 is opposite to the north pole of the magnet member 37.

The number of the neutrode members provided with such a permanent magnet pair can be made dependent on various operational parameters, as e.g. electric arc current, amount of plasma gas per time unit, flow velocity of the plasma gas, but also on the geometric dimensions of the neutrode assembly, etc. Moreover, as a further possibility of variations, magnet members having different magnetic fields can be used. In practice, it has proven useful to provide two or three of the neutrode members with a pair of permanent magnets 36, 37, whereby it is understood that this number shall not be limiting at all.

Furthermore, an important point is that the neutrode members, as far as the proposed arrangement of the magnet members is concerned, consist of a non-magnetic material, preferably of copper or a copper alloy. The advantage of permanent magnet members, as compared to e.g. electromagnets, consists in that no energy supply is required, that the design is simpler and may be realized in a more compact manner, and that a more specific influencing of the electric arc is possible.

In the following, some explanations shall be given as far as the mode of operation of the plasmatron having the characteristics according to the present invention is concerned. In view of the fact that the general mode of operation of a plasmatron is well known to any person skilled in the art, reference will be made only to the characteristics and operational parameters of the plasmatron which are essential in connection with the present invention.

An inert gas is fed through the two inlet channels 14, 15 provided in the connector body members 6, 7 in a direction running parallel to the central longitudinal axis L of the plasma channel 8. The inert gas flows into the plasma channel 8 from two opposite sides, i.e. from the left side through the annular channel 19 provided in the electrode body member 2 and from the right side through the annular channel 20 provided in the electrode body member 3. Thereby, the inert gas flows around the electrode members 9 and 10, respectively, and, thus, provides for an efficient cooling of the latter ones. Moreover, the inert gas shields the electrode members 9 and 10, respectively, with respect to the real plasma torch; this can be important particularly in the case if a reactive gas is fed through the central plasma gas channels 8.

By selecting the inert gas flowing around the electrode members 9 and 10, respectively, the base point or foot of the electric arc at the electrode members 10, 11, particularly at the anode 10, can be varied, particularly increased, resulting in a reduction of the thermal stress of the electrode members 9, 10.

By the provision of separate gas supply channels 14, 15 and 18, new possibilities are constituted. For example, it is possible, as previously mentioned, to feed an inert gas through the two channels 14 and 15 opening laterally into the plasma channel 8, while a reactive gas can be fed through the central plasma gas channels 8 of the neutrode members 1*c* . . . 1*g*, without the danger that such a mode of operation would have a negative influence on the useful service life of the electrode members 9 and 10. Moreover, by feeding a reactive gas through the plasma gas channels 18 to the plasma channel 8, an additional performance gain can be realized.

A further performance gain can be achieved by the use of inflammable gases, e.g. butane, which are fed to the plasma channel 8 through the central plasma gas channels 18. In addition to the previously mentioned performance gain, the chemical energy of the exothermic reaction process is available.

Ba the provision of a plurality of neutrode members 1*c* . . . 1*g* provided with central plasma gas channels 18, it is rendered possible that the shape of the plasma torch escaping through the aperture 40 can be varied, for example by individually controlling the velocity and amount of plasma gas flowing out of each particular plasma gas channel 18.

By the specific arrangement of the permanent magnet members 36, 37, as was explained herein before, the electric arc can be stabilized within the plasma channel 8. This results, amongst else, in a constant power supply voltage and, thus, in a constant power output of the plasmatron, in a very quiet operation and in an increased service life of the electrode members 9 and 10.

Thanks to the cascaded design of the neutrode assembly 1, the geometric dimensions of the plasmatron can be varied quickly and easily, for example by providing more or less neutrode members and/or by appropriately selecting the design and dimensions of the individual neutrode members 1*a* . . . 1*i*. For example, instead of five neutrode members 1*c* . . . 1*g* each provided with a slot-shaped aperture, it would be possible to provide seven of them, with the result that the width of the plasma torch escaping from the aperture 40 is correspondingly increased. Moreover, it would be possible to use neutrode members having a differently designed slot-shaped aperture, or neutrode members having apertures serving for the stabilization of the electric arc with a different design.

What is claimed is:

1. An indirect plasmatron for treating surfaces, comprising in combination:

a neutrode assembly having two opposite end faces and defining an elongated plasma channel having a central longitudinal axis;

a first electrode body member provided with a first electrode means and a second electrode body member provided with a second electrode means, said first and second electrode body members being connected with said neutrode assembly each at one of said opposite end faces;

means for supplying an inert gas into said plasma channel;

means for supplying a plasma gas into said plasma channel;

said first and second electrode means being located in coaxial relationship with said central longitudinal axis of said plasma channel;

said neutrode assembly comprising a plurality of plate-like neutrode members which are electrically insulated from each other;

said neutrode assembly being provided with a slot-shaped outlet aperture for the plasma torch, said outlet aperture running parallel to said central longitudinal axis of said plasma chamber;

each of said electrode means being surrounded by a cavity through which said inert gas is supplied to said plasma channel; and a permanent magnet means assembly creating a magnetic field which exercises a force in a direction opposite to the direction of flow of said plasma gas.

2. An indirect plasmatron according to claim 1 in which at least some of said neutrode members are provided with a channel means for feeding said plasma gas into said plasma channel.

3. An indirect plasmatron according to claim 2 in which said channel means extend in a substantially right angle with respect to said central longitudinal axis of said plasma channel.

4. An indirect plasmatron according to claim 1 in which said neutrode members are made of a non-magnetic material, whereby at least one of said neutrode members is provided with a pair of permanent magnet members.

5. An indirect plasmatron according to claim 4 in which said non-magnetic material is copper or a copper alloy.

6. An indirect plasmatron according to claim 4 in which each of said permanent magnet members has a north-south axis, whereby said two permanent magnet members are arranged such that their north-south axes coincide and run essentially perpendicularly to said longitudinal axis of said plasma channel, and whereby said permanent magnet members are located between said longitudinal axis of said plasma channel and said outlet aperture.

7. An indirect plasmatron according to claim 2 in which at least three of said neutrode members are provided, whereby at least one of said three neutrode members is provided with said channel means for feeding said plasma gas into said plasma channel.

8. An indirect plasmatron according to claim 1 in which said channel means for feeding said plasma gas into said plasma channel are connected with said means for supplying a plasma gas, and in which said cavities surrounding said electrode means are connected with said means for supplying an inert gas.

9. An indirect plasmatron according to claim 1 in which said neutrode assembly comprises a first plurality of plate-shaped neutrode members, each neutrode member of said first plurality provided with a slot-shaped aperture constituting a portion of said plasma channel and a portion of said slot-shaped outlet aperture for the plasma torch, whereby said channel means for feeding said plasma gas into said plasma channel open centrally into said slot-shaped aperture provided in the neutrode members of said first plurality of neutrode members.

10. An indirect plasmatron according to claim 1 in which said neutrode assembly comprises a second plurality of plate-shaped neutrode members and a third plurality of plate-shaped neutrode members, said second and third pluralities of neutrode members being located on opposite sides of said first plurality of neutrode members, each neutrode member of said second and third pluralities of neutrode members being provided with a central bore constituting a portion of said plasma channel and adapted to stabilize the electric arc in a desired position.

11. An indirect plasmatron according to claim 1 in which one of said first and second electrode means constitutes the anode and having an essentially flat end surface on which the electric arc starts and ends, respectively.

12. An indirect plasmatron according to claim 11 in which the other one of said first and second electrode means constitutes the cathode and having an essentially cone-shaped tip on which the electric arc starts and ends, respectively.

* * * * *